US009098036B1

(12) United States Patent
Tanaka

(10) Patent No.: US 9,098,036 B1
(45) Date of Patent: Aug. 4, 2015

(54) FIXING DEVICE, IMAGE FORMING APPARATUS INCLUDING FIXING DEVICE

(71) Applicant: KYOCERA Document Solutions Inc., Osaka-shi, Osaka (JP)

(72) Inventor: Kei Tanaka, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/595,587

(22) Filed: Jan. 13, 2015

(30) Foreign Application Priority Data

Jan. 21, 2014 (JP) ..... 2014-008280

(51) Int. Cl.
*G03G 15/20* (2006.01)

(52) U.S. Cl.
CPC ..... *G03G 15/2053* (2013.01); *G03G 15/2064* (2013.01)

(58) Field of Classification Search
CPC ..... G03G 15/2053; G03G 15/2064
USPC ..... 399/328, 330, 334; 219/216
See application file for complete search history.

(56) References Cited

U.S. PATENT DOCUMENTS

2004/0037597 A1* 2/2004 Haseba et al. ..... 399/328
2011/0091230 A1* 4/2011 Yamamoto ..... 399/69

FOREIGN PATENT DOCUMENTS

JP 2001125407 A 5/2001

* cited by examiner

*Primary Examiner* — Hoang Ngo
(74) *Attorney, Agent, or Firm* — Alleman Hall McCoy Russell & Tuttle LLP

(57) ABSTRACT

A fixing device includes a primary winding, a fixing portion, a secondary winding, and a magnetic core body. The primary winding is configured to receive a supply of AC current from an AC power source. The fixing portion includes a heat source that generates heat when an electric current is supplied to the heat source, the fixing portion being configured to execute a fixing process onto a sheet with a toner image formed on the sheet, at a predetermined fixing temperature by using the heat from the heat source. The secondary winding is electrically connected to the heat source. The primary winding and the secondary winding are wound around the magnetic core body. The magnetic core body is made of a predetermined material whose permeability is lowered when a temperature thereof becomes equal to or higher than the predetermined fixing temperature upon receiving the heat from the heat source.

6 Claims, 3 Drawing Sheets

FIXING DEVICE, IMAGE FORMING APPARATUS INCLUDING FIXING DEVICE

INCORPORATION BY REFERENCE

This application is based upon and claims the benefit of priority from the corresponding Japanese Patent Application No. 2014-008280 filed on Jan. 21, 2014, the entire contents of which are incorporated herein by reference.

BACKGROUND

The present disclosure relates to a fixing device for executing a fixing process onto a sheet on which a toner image has been formed, and to an image forming apparatus including the fixing device.

Conventionally, there have been known an image forming apparatus including a print mechanism of the electrophotography, such as a copier, printer, facsimile, and multifunction peripheral in which functions of these are installed. The image forming apparatus includes a fixing device. The fixing device includes a heating roller and a pressure roller, wherein the surface of the heating roller is heated by a heat source, and the rotational axis of the pressure roller is set to be parallel to the rotational axis of the heating roller. When a sheet with a toner image formed on the surface thereof passes through the fixing device, the sheet is heated while being nipped by the pressure roller and the heating roller with a certain pressure. This allows the toner to be fused and adhered to the sheet, thereby an image is fixed to the sheet.

Meanwhile, to improve the convenience of the user by reducing the warm-up time, the fixing device is required to have performance to raise the heating temperature in the fixing device as fast as possible. Conventionally, there is known a fixing device that has reduced the thermal capacity thereof by adopting, for example, a thin belt as a member for giving heat to the sheet and to the toner image formed on the sheet, in order to raise the heating temperature in the fixing device as fast as possible.

SUMMARY

A fixing device according to an aspect of the present disclosure includes a primary winding, a fixing portion, a secondary winding, and a magnetic core body. The primary winding is configured to receive a supply of AC current from an AC power source. The fixing portion includes a heat source that generates heat when an electric current is supplied thereto, the fixing portion being configured to execute a fixing process onto a sheet with a toner image formed thereon, at a predetermined fixing temperature by using the heat from the heat source. The secondary winding is electrically connected to the heat source. The primary winding and the secondary winding are wound around the magnetic core body. The magnetic core body is made of a predetermined material whose permeability is lowered when a temperature thereof becomes equal to or higher than the predetermined fixing temperature upon receiving the heat from the heat source.

An image forming apparatus according to another aspect of the present disclosure includes the fixing device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclusure with reference to the drawings. It should be noted that the following description is an example of a specific embodiment of the present disclosure and should not limit the technical scope of the present disclosure.

Figure 1:
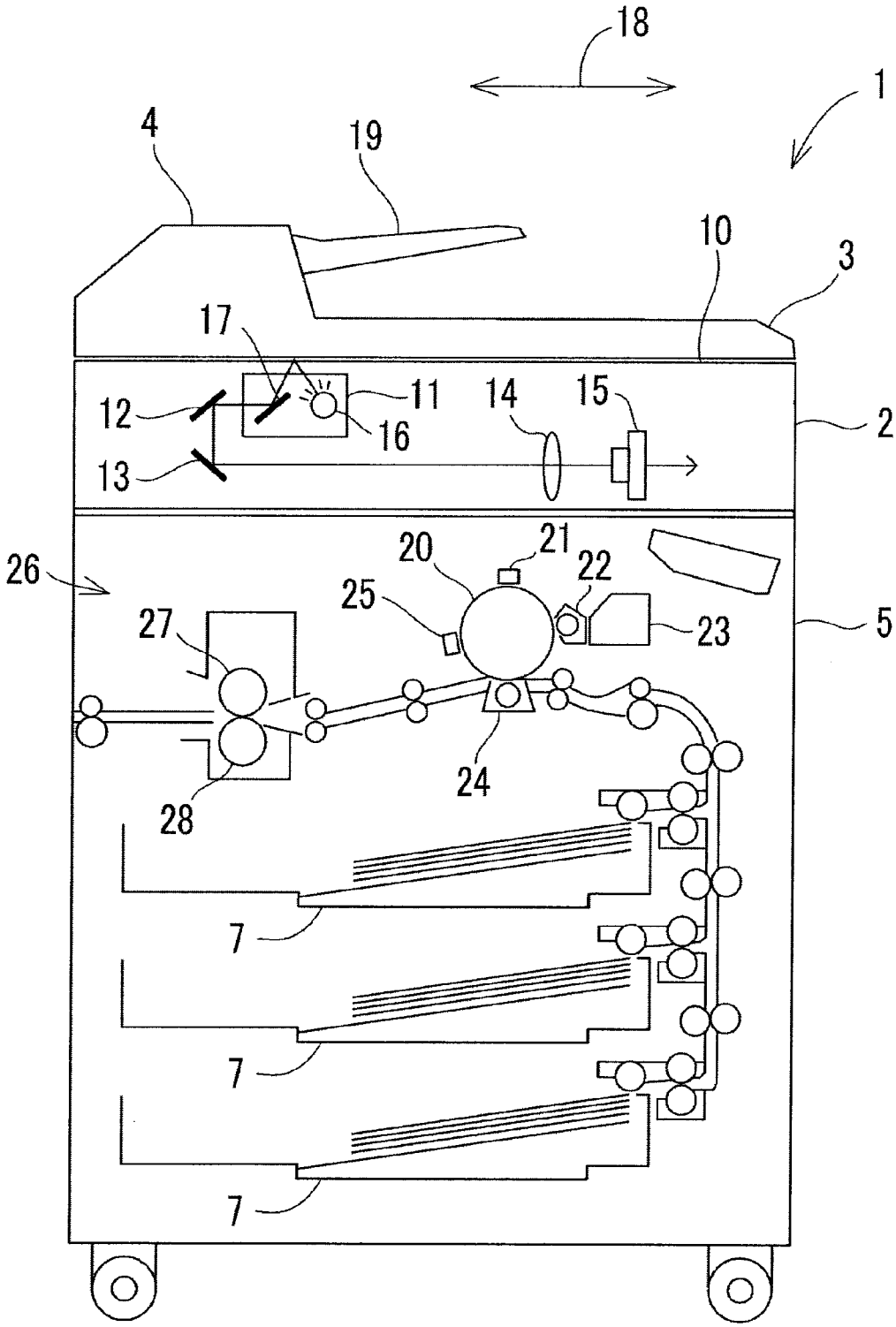
FIG. 1 is a diagram showing the internal configuration of an image forming apparatus according to an embodiment of the present disclosure.

First, an outlined configuration of an image forming apparatus 1 in an embodiment of the present disclosure is described. The image forming apparatus 1 is a multifunction peripheral having an image reading function, a facsimile function, an image forming function and the like. As shown in FIG. 1, the image forming apparatus 1 includes an image reading portion 2, a document sheet cover 3, an ADF (Auto Document Feeder) 4, an image forming portion 5, and a sheet feed cassette 7. It is noted that although the image forming apparatus 1 which is a multifunction peripheral is described as an example of the image forming apparatus of the present disclosure, the present disclosure is not limited thereto. For example, the image forming apparatus of the present disclosure may be a printer, a facsimile apparatus, a copier, or a scanner apparatus.

The image reading portion 2 executes an image reading process of reading image data from the document sheet. As shown in FIG. 1, the image reading portion 2 includes a contact glass 10, a reading unit 11, mirrors 12, 13, an optical lens 14, a CCD (Charge Coupled Device) 15, and the like.

The reading unit 11 includes an LED light source 16 and a mirror 17. The reading unit 11 is configured to be moved in a sub scanning direction 18 (the left-right direction in FIG. 1) by a moving mechanism (not shown) that uses a driving mortor such as a stepping motor. The contact glass 10 is provided on the upper surface of the image reading portion 2. While the reading unit 11 is being moved in the sub scanning direction 18 by the driving mortor, light is irradiated from the LED light source 16 toward the contact glass 10. This allows the light to be scanned in the sub scanning direction 18.

The mirror 17 reflects, toward the mirror 12, light which was irradiated from the LED light source 16 and reflected on the document sheet or the rear surface of the document sheet cover 3. The light reflected on the mirror 17 is guided into the optical lens 14 by the mirrors 12 and 13. The optical lens 14 condenses the incident light and makes the condensed light incident on the CCD 15.

The CCD 15 is a photoelectric converting element as an imaging element. The CCD 15 converts the received light into an electric signal (voltage), which corresponds to an amount of the received light (level of brightness), and outputs the electric signal to a control portion (not shown). The control portion generates image data of the document sheet by performing image processing of the electric signal from the CCD 15. It is noted that, although the present embodiment describes an example where the CCD 15 is used as an imaging element, the present embodiment is applicable to a reading mechanism using a CIS (Contact Image Sensor) instead of a reading mechanism using the CCD 15. Here, the CIS is an image sensor of a close contact type, having a shorter focal distance than the CCD 15.

The document sheet cover 3 is pivotably provided on the image reading portion 2. The contact glass 10 on the upper surface of the image reading portion 2 is opened and closed when the document sheet cover 3 is pivitally operated. At a portion where the document sheet cover 3 is pivotably supported, a cover opening detecting sensor (not shown) such as a limit swich is provided. When the document sheet cover 3 is opened to cause an image to be read from a document sheet, the cover opening detecting sensor is activated, and the detection signal (cover opening detection signal) thereof is output to the control portion.

Here, the image reading portion 2 reads an image from a document sheet in the following procedure. First, a document sheet is placed on the contact glass 10, and the document sheet cover 3 is closed. Subsequently, when an image reading instruction is input from an operation display portion (not shown), the reading unit 11 is moved rightward along the sub scanning direction 18, while a line of light is continually irradiated from the LED light source 16 in sequence toward the contact glass 10. Light reflected on the document sheet or the rear surface of the document sheet cover 3 is guided into the CCD 15 via the mirrors 17, 12 and 13 and the optical lens 14. Subsequently, light amount data which corresponds to the amount of light received by the CCD 15 is output in sequence from the CCD 15 to the control portion. Upon obtaining light amount data of the whole area on which the light was irradiated, the control portion generates the image data of the document sheet from the light amount data by processing the light amount data.

The document sheet cover 3 includes the ADF 4. The ADF 4 sequentially moves one or more document sheets set on a document sheet setting portion 19 by a plurality of conveyance rollers so that the document sheet passes, rightward in the sub scanning direction 18, an automatic document sheet reading position provided on the contact glass 10. In the case where the document sheet is moved by the ADF 4, the reading unit 11 is disposed below the automatic document sheet reading position, and the image of the document sheet is read by the reading unit 11 at this position while the document sheet is moving. The document sheet setting portion 19 includes a mechanical sheet sensor (not shown) that can output a contact point signal. When a document sheet is set on the document sheet setting portion 19, the sheet sensor is activated, and the detection signal (document sheet detection signal) thereof is output to the control portion.

As shown in FIG. 1, the image forming portion 5 executes an image forming process (print process) based on the electrophotography. The image forming portion 5 executes the image forming process based on image data which has been read by the image reading portion 2, or based on a print job input from an external information processing apparatus such as a personal computer. The image forming portion 5 includes a photoconductor drum 20, a charging portion 21, a developing portion 22, a toner container 23, a transfer roller 24, an electricity removing portion 25, and a fixing device 26. It is noted that although the image forming portion 5 of the electrophotography is described as an example, the image forming portion 5 is not limited to the electrophotography, but may adopt an inkjet recording method or other recording or printing methods.

In the image forming portion 5, an image is formed in the following procedure on a paper sheet supplied from the sheet feed cassette 7. First, when a print job including a print instruction is input from an external apparatus, the charging portion 21 charges the surface of the photoconductor drum 20 uniformly into a certain potential. Next, a laser scanner unit (not shown) irradiates the surface of the photoconductor drum 20 with light based on the image data included in the print job. With this operation, an electrostatic latent image is formed on the surface of the photoconductor drum 20. Then the electrostatic latent image on the photoconductor drum 20 is developed (visualized) into a toner image by the developing portion 22. It is noted that the toner (developer) is supplied to the developing portion 22 from the toner container 23. Subsequently, the toner image formed on the photoconductor drum 20 is transferred to a sheet by the transfer roller 24. After the transfer, the potential of the photoconductor drum 20 is removed by the electricity removing portion 25. Subsequently, the toner image transferred to the sheet is heated so as to be fused and fixed to the sheet when the sheet is passed through the fixing device 26 and then discharged.

Figure 2:
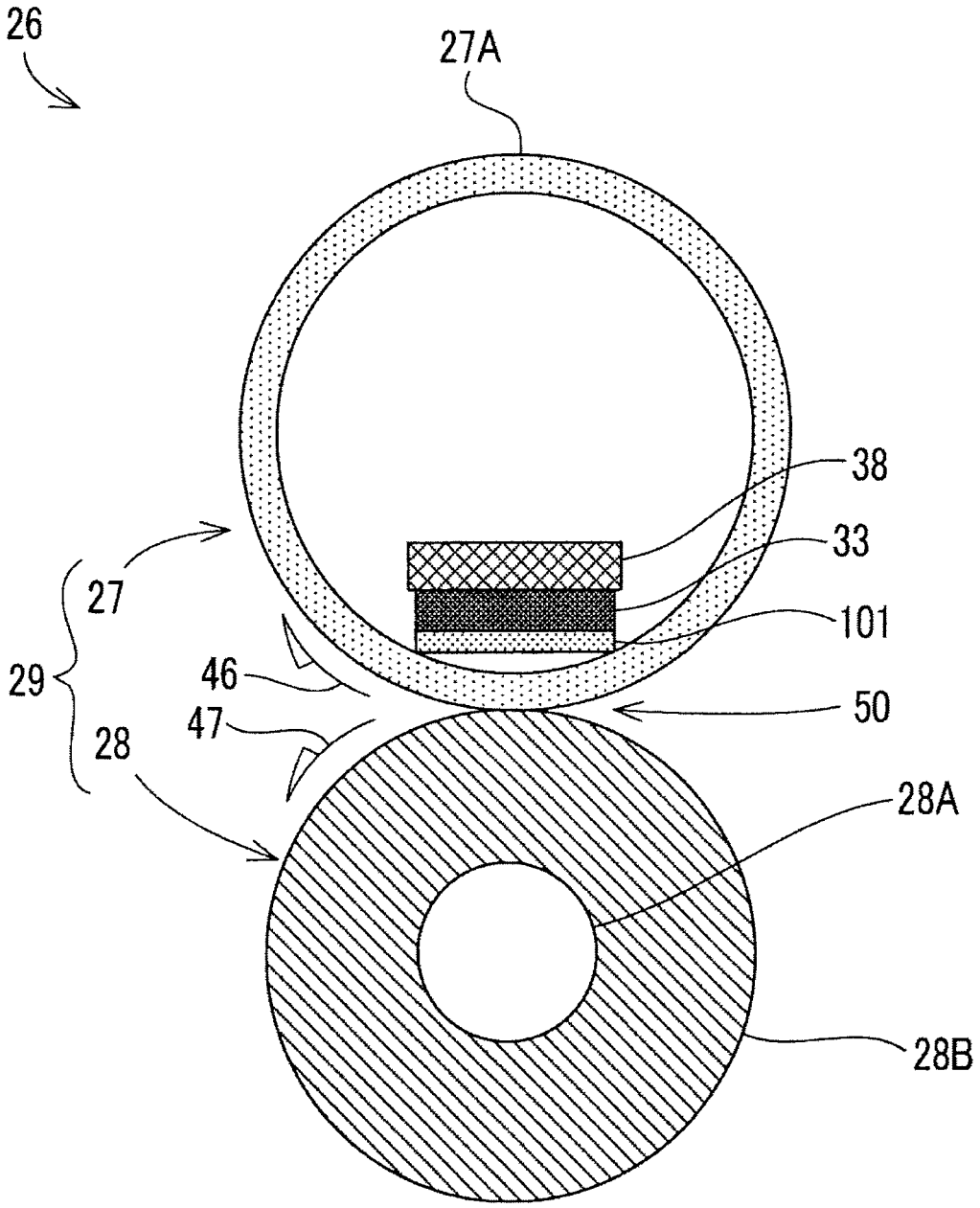
FIG. 2 is a diagram showing the configuration of a fixing device according to an embodiment of the present disclosure.
Figure 3:
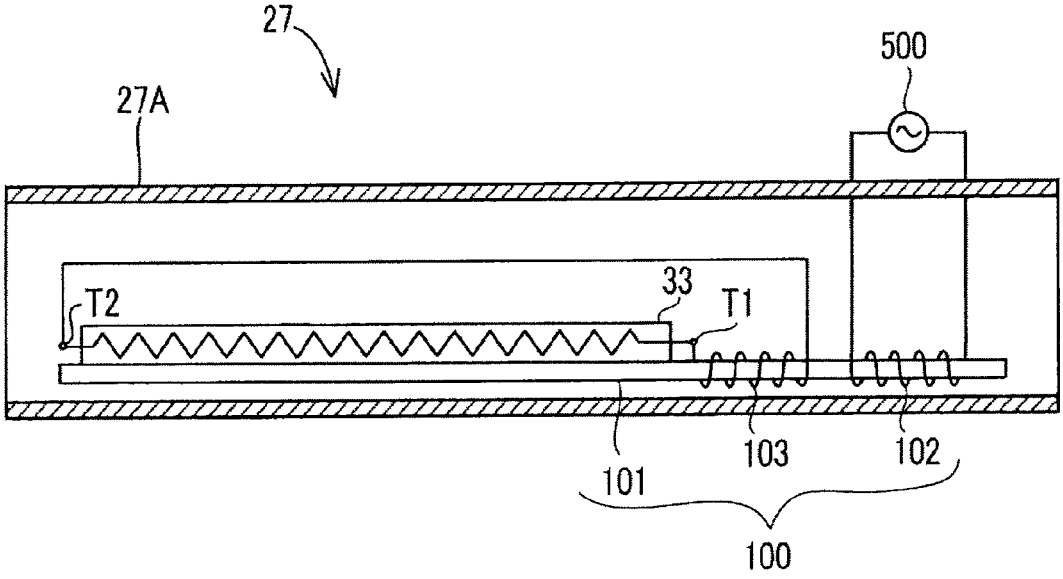
FIG. 3 is a diagram showing the configuration of a heating roller of the fixing shown in FIG. 2.

As shown in FIG. 2, the fixing device 26 heats the toner image transferred to the sheet so as to be fused and fixed to the sheet. The fixing device 26 includes a fixing portion 29. The fixing portion 29 includes a heating roller 27 and a pressure roller 28.

The heating roller 27 is an elongated member extending in the front-rear direction of the image forming apparatus 1 (the front-rear direction of the paper surface of FIG. 1). The heating roller 27 includes a roller main body 27A formed in a shape of a cylinder. The circumferential surface of the roller main body 27A comes into contact with an image surface of the sheet (a side of the sheet to which the toner image has been adhered) during a fixing process. The roller main body 27A is a cylindrical portion that contacts and heats the sheet.

The roller main body 27A is made of a material having high thermal conductivity, such as a metal like aluminum. The roller main body 27A is rotatably supported by an elongated guide member that is supported, at opposite ends thereof, by a frame (not shown) of the fixing device 26. The heating roller 27 rotates following the rotation of the pressure roller 28.

The roller main body 27A is formed to be long enough to contact a sheet that has the maximum width to which the fixing device 26 can fix an image. In the present embodiment, the fixing device 26 can fix an image to a sheet of an A3 size (420 mm×297 mm), and the roller main body 27A is formed to be longer than the short side of the A3 size (297 mm).

The pressure roller 28 is disposed to face the heating roller 27. The pressure roller 28 is parallel to the heating roller 27, and is rotatably supported in the state where it is pressed against the surface of the heating roller 27. The pressure roller 28 includes a spindle 28A (see FIG. 2) at its center. The spindle 28A is rotatably supported by the frame (not shown) of the fixing device 26. This enables the pressure roller 28 to rotate. When a motor (not shown) is rotationally driven, the rotational driving force thereof is transmitted to the pressure roller 28, and the pressure roller 28 rotates in a predetermined direction. In the present embodiment, the pressure roller 28 is rotated counterclockwise in FIG. 2 (see the arrow 47). A cylindrical elastic portion 28B is provided on the spindle 28A of the pressure roller 28, wherein the elastic portion 28B is made of an elastic material such as silicon or porous rubber. The pressure roller 28 is made pressure-contact with the heating roller 27 by a spring or the like. This allows the elastic portion 28B to be elastically deformed in a shape of a dented curve by the roller main body 27A, and a nip portion 50 is formed therebetween.

A heater 33 as a heat source is provided fixedly inside the heating roller 27, wherein the heater 33 generates heat when an electric current is supplied thereto. As shown in FIG. 2, the heater 33 is attached to an elongated support member 38 that is supported, at opposite ends thereof, by the frame (not shown) of the fixing device 26. The heater 33 is composed of, for example, a halogen heater or a ceramic heater, and irradiates heat when power is supplied thereto. With this configuration, the whole roller main body 27A of the heating roller 27 is heated from inside by the heater 33. In the present embodiment, the heater 33 is fixed at a position that is closer to the nip portion 50 than to the center of the roller main body 27A in a cross section.

In the fixing device 26, the sheet is conveyed to pass through the nip portion 50 from right to left. Being made pressure-contact with the pressure roller 28 that is rotationally driven, the heating roller 27 follows the rotation of the pressure roller 28 and rotates clockwise in FIG. 2 (see the arrow 46). As a result, in the nip portion 50, the sheet is conveyed leftward while being nipped by the heating roller 27 and the pressure roller 28 and receiving heat. At this time, the heat supplied from the heating roller 27 allows the toner image adhered to the sheet to be fused and fixed to the sheet.

Meanwhile, in such fixing device 26, it is desirable to improve the convenience of the user by reducing the warm-up time during which the heating roller 27 is heated from a cooled state to a predetermined fixing temperature. To increase the heating temperature in the fixing device 26 as fast as possible, a member having a low thermal capacity may be adopted as a member (for example, the roller main body 27A of the heating roller 27) that gives heat to the sheet or the toner image.

The fixing device 26 is provided with a sensor (not shown) for detecting the temperature of the heating roller 27 of the fixing device 26 itself. The heating temperature in the fixing device 26 is controlled based on the temperature indicated by the detection signal of the sensor. Here, in the fixing device 26 in which the temperature is raised at a high speed as described above, the temperature may change in a very short time, and as a result, the temperature of the heating roller 27 may temporarily exceed a target temperature (a temperature suitable for the fixing). This is because the temperature control of the heating roller 27 delays relative to the real temperature change, due to, for example, the time required for the sensor to detect the temperature, the processing time of the CPU that performs the temperature control, and the time required to stop the current from being supplied to the heater 33 that is the heat source.

In the present embodiment, to prevent the temperature of the heating roller 27 of the fixing device 26 from exceeding the target temperature, the fixing device 26 includes an excess temperature rise preventing mechanism 100. The excess temperature rise preventing mechanism 100 includes a magnetic core body 101, a primary winding 102, and a secondary winding 103.

The magnetic core body 101 is an elongated body having a thin rectangular parallelepiped shape and extending from an end to the other end of the heating roller 27. The magnetic core body 101 is attached to the top cover 33 so as to be in contact with the top cover 33. This allows the magnetic core body 101 to be heated by receiving heat from the heater 33. The magnetic core body 101 is provided between the vicinity of the nip portion 50 of the roller main body 27A and the heater 33.

The magnetic core body 101 is made of a temperature sensitive magnetic material whose permeability changes with temperature. With regard to the temperature sensitive magnetic material in the present embodiment, its magnetic characteristic reversibly transits between ferromagnetic and non-magnetic (paramagnetic) based on the temperature. Specifically, with regard to the temperature sensitive magnetic material in the present embodiment, within a temperature range of lower than Curie temperature, the permeability is approximately constant, or slightly increases as the temperature rises, and within a temperature range of equal to or higher than Curie temperature, magnetism is lost. It is noted that a case where the temperature sensitive magnetic material loses magnetism includes a case where the permeability is represented by a very small value. Such a temperature sensitive magnetic material is made of, for example, an alloy of iron and nickel, an alloy of iron, nickel and chrome, or an alloy of copper and nickel. The Curie temperature for the temperature sensitive magnetic material is determined based on the composition ratio of the metals composing the alloy.

Here, in the present embodiment, with the adjustment of the composition ratio, the Curie temperature is set to the target temperature, namely, a fixing temperature suitable for fixing the toner image to the sheet by the fixing device 26. The target temperature is set to, for example, 160° C. to 180° C.

The magnetic core body 101 is wound with the primary winding 102 and the secondary winding 103. In the primary winding 102, a predetermined metal wire is wound to have a predetermined number of turns. The primary winding 102 is connected to an AC power source 500 provided in the image forming apparatus 1. The AC power source 500 applies a predetermined AC current having predetermined frequency and amplitude to opposite ends of the primary winding 102. An end of the secondary winding 103 is electrically connected to a terminal T1 of the heater 33 of the fixing portion 29, and the other end of the secondary winding 103 is electrically connected to a terminal T2 of the heater 33. As a result, when a current flows through the secondary winding 103, the current also flows through the heater 33. This causes the heater 33 to generate heat.

When an AC current is supplied from the AC power source 500 to the primary winding 102, one or more lines of magnetic force are generated in the primary winding 102 by the AC current, and the number of the lines of magnetic force changes based on the frequency and the like of the AC current. Accordingly, the number of lines of magnetic force that pass through the secondary winding 103 also changes, and an induced electromotive force is generated in the secondary winding 103 by the electromagnetic induction caused by the change in the number of lines of magnetic force. This leads to occurrence of AC current in the secondary winding 103. The AC current that occurred to the secondary winding 103 is supplied to the heater 33, and the heater 33 irradiates Joule heat.

In the present embodiment, the primary winding 102 and the secondary winding 103 are wound around the magnetic core body 101 to be close to each other in the longitudinal direction of the magnetic core body 101. With this configuration, compared to a configuration where the primary winding 102 and the secondary winding 103 are wound around the magnetic core body 101 to be separated away from each other, lines of magnetic force that pass through the secondary winding 103, among the lines of magnetic force generated in the primary winding 102 by the AC current supplied from the AC power source 500, have high density. As a result, a large induced electromotive force is generated in the secondary winding 103 by the electromagnetic induction. This enables a ratio of the amount of heat generated by the heater 33 to the level of current supplied to the primary winding 102, namely a power efficiency, to be as high as possible.

The magnetic core body 101 is heated by the heater 33 and reaches the Curie temperature. When the magnetic core body 101 reaches the Curie temperature, the permeability of the magnetic core body 101 is drastically lowered and the magnetic core body 101 loses magnetism. Thus no line of magnetic force passes through the secondary winding 103. As a result, the induced electromotive force is not generated, and the current does not flow through the secondary winding 103. Since the heater 33 is connected to the secondary winding 103, when no current flows through the secondary winding 103, no current flows through the heater 33. Thus the heater 33 stops generating heat. As a result, the temperature rise of the magnetic core body 101 stops, and the temperature of the magnetic core body 101 falls.

When the temperature of the magnetic core body 101 becomes lower than the Curie temperature, the magnetic core body 101 returns from nonmagnetic (paramagnetic) to ferromagnetic. Since the AC power source 500 keeps on supplying the AC current to the primary winding 102, many of the lines of magnetic force generated in the primary winding 102 come to pass through the secondary winding 103, and a current is generated in the secondary winding 103 again by the electromagnetic induction. When a current flows through the secondary winding 103, a current also flows through the heater 33. This allows the heater 33 to generate heat, which causes the temperature of the heating roller 27 to rise and reach the Curie temperature again. When the temperature of the magnetic core body 101 reaches the Curie temperature, the permeability of the magnetic core body 101 is drastically lowered again and the magnetic core body 101 loses magnetism. Thus no line of magnetic force passes through the secondary winding 103 as in the above-described case. In this way, the state transition is repeated.

As described above, according to the present embodiment, when the temperature of the magnetic core body 101 becomes equal to or higher than the Curie temperature, the supply of current to the heater 33 is stopped; and when the temperature of the magnetic core body 101 becomes lower than the Curie temperature, the supply of the current to the heater 33 is resumed. With this configuration, the temperature of the magnetic core body 101 is stabilized in the vicinity of the Curie temperature and the fixing temperature. Accordingly, it is possible to prevent the temperature of the roller main body 27A from exceeding the target temperature. As a result, the temperature for heating the sheet is stabilized to the fixing temperature.

That is, in the present embodiment, the on/off of the supply of current to the heater 33 is controlled by the magnetic core body 101 in which the fixing temperature is set to the Curie temperature. As a result, according to the present embodiment, the on/off of the supply of current to the heater 33 is not intervened by, as observed in the conventional technology, the time required for the sensor to detect the temperature, the processing time of the CPU and the like. That is, compared to the conventional technology, responsiveness of the on/off of the supply of current to the heater 33 is high. As a result, it is possible to prevent the temperature of the roller main body 27A from exceeding the target temperature.

Up to now, a preferable embodiment of the present disclosure has been described. However, the present disclosure is not limited to the embodiment described so far, but is applicable to various modifications.

In the above-described embodiment, the magnetic core body 101 is in contact with the heater 33, but this configuration is not indispensable. However, such a configuration where the magnetic core body 101 is in contact with the heater 33 is preferable. This is because when the magnetic core body 101 is in contact with the heater 33, the temperature of the magnetic core body 101 approximates most to the actual temperature of the heater 33. That is, an error between the temperature at which the magnetic core body 101 loses magnetism (the temperature of the magnetic core body 101 when the supply of current to the heater 33 is stopped) and the actual temperature of the heater 33 becomes minimum, and it becomes possible to accurately control the on/off of the supply of current to the heater 33. In addition, in the above-described embodiment, the magnetic core body 101 is provided between the roller main body 27A and the heater 33. However, not limited to this configuration, for example, the magnetic core body 101 may be provided on a surface of the heater 33 opposite to the nip portion.

In the above-described embodiment, the primary winding 102 and the secondary winding 103 are wound around the magnetic core body 101 to be close to each other. However, as far as the primary winding 102 and the secondary winding 103 are magnetically coupled to each other, the primary winding 102 and the secondary winding 103 may not necessarily be wound around the magnetic core body 101 to be close to each other, but may be separated from each other in the extension direction of the magnetic core body 101. However, it is most preferable that the primary winding 102 and the secondary winding 103 are close to each other. This is because, with this configuration, lines of magnetic force that pass through the secondary winding 103, among the lines of magnetic force generated in the primary winding 102, have highest density (the largest number of lines), and it is possible to increase the induced electromotive force generated in the secondary winding 103, and the current flowing through the heater 33. That is, the power efficiency for generation of heat by the heater 33 becomes the maximum.

In the above-described embodiment, the magnetic core body 101 is made of a temperature sensitive magnetic material. However, as far as the magnetic core body 101 is made of a material that loses magnetism at the fixing temperature, the magnetic core body 101 may not be made of a temperature sensitive magnetic material.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A fixing device comprising:

a primary winding configured to receive a supply of AC current from an AC power source;

a fixing portion including a heat source that generates heat when an electric current is supplied thereto, the fixing portion being configured to execute a fixing process onto a sheet with a toner image formed thereon, at a predetermined fixing temperature by using the heat from the heat source;

a secondary winding electrically connected to the heat source; and a magnetic core body around which the primary winding and the secondary winding are wound and which is made of a predetermined material whose permeability is lowered when a temperature thereof becomes equal to or higher than the predetermined fixing temperature upon receiving the heat from the heat source.

2. The fixing device according to claim 1, wherein the magnetic core body is in contact with the heat source.

3. The fixing device according to claim 1, wherein the fixing portion includes a cylindrical portion that contacts and heats the sheet, and the magnetic core body is provided between the fixing portion and the heat source.

4. The fixing device according to claim 1, wherein the primary winding and the secondary winding are wound around the magnetic core body to be close to each other.

5. The fixing device according to claim 1, wherein the predetermined material is a temperature sensitive magnetic material, and a Curie temperature for the temperature sensitive magnetic material is set to the predetermined fixing temperature.

6. An image forming apparatus comprising the fixing device according to claim 1.

* * * * *